United States Patent [19]

Foegen

[11] Patent Number: 4,831,690

[45] Date of Patent: May 23, 1989

[54] CARRYING HANDLE HAVING L-SHAPED MEMBERS EACH INCLUDING A FOOT PORTION ENGAGEABLE WITH CORRUGATED CARDBOARD

[76] Inventor: Robert C. Foegen, 1613 Chapman Dr., Waukesha, Wis. 53186

[21] Appl. No.: 748,706

[22] Filed: Jun. 25, 1985

Related U.S. Application Data

[63] Continuation of Ser. No. 597,041, Apr. 5, 1984, abandoned.

[51] Int. Cl.[4] ..... B65D 25/28

[52] U.S. Cl. ..... 16/114 R; 16/110 R; 16/DIG. 24; 294/15; 294/26; 294/169

[58] Field of Search ..... 16/110 R, 114 R, 120, 16/124, 125, DIG. 24; 229/52 A, 52 AM, 52 AW, 68 C; 383/13; 294/15, 16, 26, 30, 169, 170

[56] References Cited

U.S. PATENT DOCUMENTS

| | | | |
|---|---|---|---|
| 63,086 | 3/1867 | Peebels | 294/170 X |
| 1,245,216 | 11/1917 | Gohlke | 294/26 |
| 1,345,889 | 7/1920 | Schmertz | 294/26 |
| 1,687,552 | 10/1928 | Fassbender | 16/114 R X |
| 3,407,988 | 10/1968 | Wapner | 16/114 R X |
| 4,171,144 | 10/1979 | Rodriguez | 16/114 A |

*Primary Examiner*—Fred A. Silverberg
*Attorney, Agent, or Firm*—Bayard H. Michael

[57] ABSTRACT

A handle for attachment to a carton to facilitate carrying the carton. The elongated handle has the upper end of the leg portion of each of two L-shaped members connected to the same end of the handle so each foot portion of the members projects parallel to the handle. The tip of each of the feet is sharpened to facilitate puncturing the carton. The members are pivotally connected to the handle to allow the members to be collapsed. The sharpened tip of each foot portion tapers downwardly and rearwardly from the end to meet the lower portion of the foot portion at a rocker area about which the foot portion can rock to lower the junction of the foot and leg portions of each member toward the carton after the carton surface has been punctured. This allows the foot portions to run between the surfaces of corrugated cardboard.

5 Claims, 1 Drawing Sheet

CARRYING HANDLE HAVING L-SHAPED MEMBERS EACH INCLUDING A FOOT PORTION ENGAGEABLE WITH CORRUGATED CARDBOARD

This is a continuation of co-pending application Ser. No. 597,041 filed on Apr. 5, 1984 now abandoned in favor of this application.

BACKGROUND OF THE INVENTION

This invention relates to a device which may be temporarily mounted on a corrugated box to provide a carrying handle. The prior art handles have generally required attachment to ropes (which is not convenient or fast) or puncture the carton and may damage the contents.

SUMMARY OF THE INVENTION

This invention provides a handle which can be readily attached to a corrugated carton to enable carrying the carton easily. The handle is readily removed. The handle will support a considerable weight.

This invention provides two L-shaped members each having a leg portion connected to a handle so the foot portion of each member projects parallel to the handle and to the other foot portion. The free end or tip of each foot portion is sharpened to pierce a cardboard carton.

The foot portion of the members is not thicker than the space between the outer (paper) surfaces of corrugated cardboard. The sharp ends of the feet can pierce only the top layer. Each sharp end tapers back and down to a rocker portion about which the foot portion can rock after the sharp end has pierced the top surface. This lets the foot portion approach parallelism with the corrugated cardboard surfaces so the legs can run between the surfaces to avoid making a hole to the interior of the carton. The two legs between the outer surfaces can support substantial weight. Mounting this handle is especially easy if the foot portions are running between the corrugations rather than across (through) the corrugations.

The handle is easily folded for storage or for carrying in a salesman's briefcase. When he needs to carry a carton to a customer, he spreads the members, pokes the sharp ends through the top surface only, tilts the device so the tips stay between the surfaces of the cardboard while the foot portions approach parallelism with the cardboard. This positions the rocker portion to deflect the feet between the outer surfaces of the cardboard. When the feet are run into the space occupied by the corrugations between the upper and lower surfaces, there is a considerable contact area which is able to support a substantial load. The handle is easily removed. The carton is not punctured all the way through.

This invention is not limited to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DETAILED DESCRIPTION OF THE DRAWINGS

Figure 5:
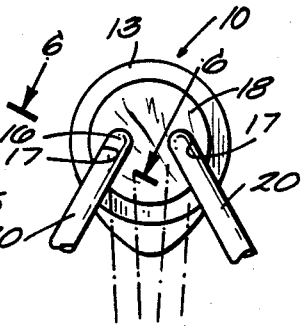
FIG. 5 is a view taken from line 5—5 in FIG. 1.
Figure 6:
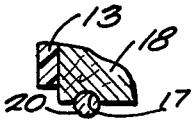
FIG. 6 is taken on line 6—6 in FIG. 5 to show the detent action.

The handle 10 is provided with two L-shaped members 12, 12 which are designed to pierce the carton 14. Each member has a short stub 16 which is pivotally mounted in the end of the plug 18 in the handle. Other methods of mounting will be apparent. The mounting should allow each L-shaped member to swing about the handle to allow the members to move from the collapsed position shown in dotted lines in FIG. 5 to the "use" position shown in solid lines in FIG. 5 and in FIG. 1. In the "use" position the leg portion of each member lies in a shallow depression 17 in plug 18 (or the grip 13) to detent the action. In the storage position the leg portions lie in the shallow groove between the detent grooves. This holds the L-shaped members in a compact position enabling easy storage in a briefcase or the like.

Figure 2:
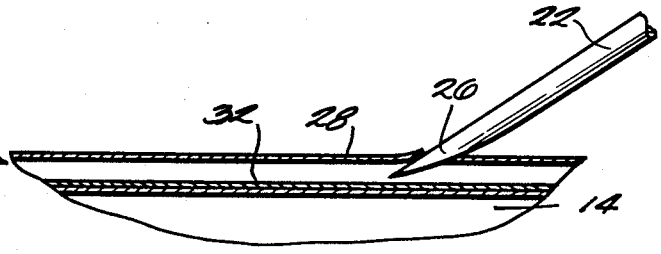
FIGS. 2–4 are fragmentary sections showing the sequence of piercing the top layer of a corrugated cardboard carton, rocking the foot portion to enable the foot portion to travel between the layers to the final position shown in FIG. 4.
Figure 3:
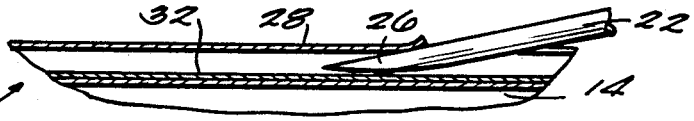
Figure 4:
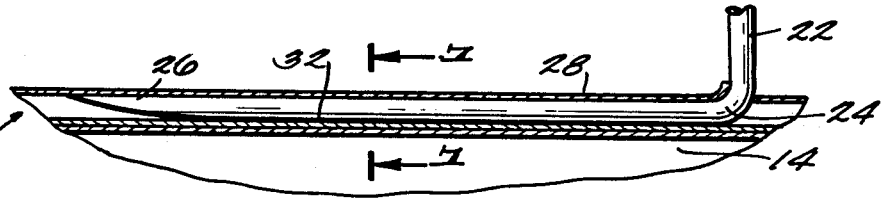
Figure 7:
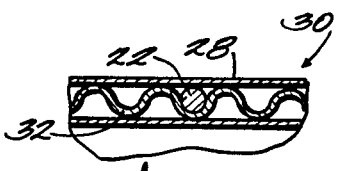
FIG. 7 is a sectional view on line 7—7 in FIG. 4.

Each L-shaped member includes a leg portion 20 and a foot portion 22 joined at a heel 24. The free end or tip of each foot 22 is sharpened with the underside of the end sloping downwardly and rearwardly (all relative to the "use" position) to a rocker portion 26. After the top paper layer 28 of the corrugated cardboard 30 has been pierced (FIG. 2) the foot portion is advanced while the heel is depressed so the rocker portion 26 engages and is deflected by the inside (top) of the bottom paper surface 32 (FIG. 3) to cause the foot to run between the surfaces 28, 32 of the cardboard until the heel engages the hole as in FIG. 4. It is preferred that the feet run parallel to the corrugations (FIG. 7) since this offers the easiest entry.

Figure 1:
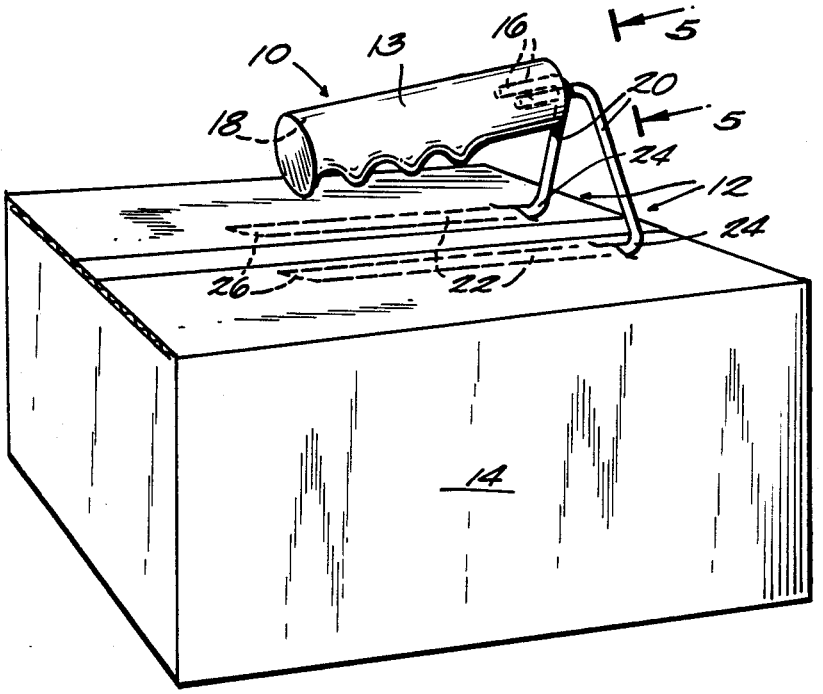
FIG. 1 is a perspective view showing the handle fixed on a relatively small carton.

When the foot portions are mounted as in FIG. 1, the hdndle can lift a substantial load without tearing through the cardboard. The contents are still secure since there is no hole through the carton. This device has been used with great success and is a boon to salesmen. It can be made at low cost enabling stores to provide the handle to customers to encourage them to carry their purchase instead of asking for delivery.

I claim:

1. A carrying device for attachment to a carton to facilitate carrying the carton, an elongated handle having an axis and first and second ends, a pair of L-shaped members each having a generally vertical leg portion having an upper end and a lower end, each L-shaped member also having a generally horizontal foot portion having one end connected to and extending from said lower end of said leg portion and having its other end free, a generally horizontal mounting stub coplanar with said leg portion and with said foot portion and projecting from said upper end of said leg portion of each said L-shaped member, each said mounting stub being pivotally mounted in said first end of said handle for movement about a pivot axis parallel to said axis of said handle, each said L-shaped member being movable about its said pivot axis to bring said foot portions together generally coplanar with said handle, each said foot portion extending from said leg portion at least substantially as far as said handle extends from said leg portion, each said foot portion being generally parallel to said handle, said free end of each of said foot portions being sharpened to facilitate puncturing said carton, the space between said second end of said handle and said free ends of said foot portions being open.

2. A carrying device according to claim 1 in which said foot portions are spaced apart and are substantially equidistant from said handle when the device is in use.

3. A carrying device according to claim 2 in which each said foot portion has an upper part and a lower part and said sharpened distal end of each said foot portion tapers downwardly and rearwardly from said upper part of said end to meet said lower part of said foot portion to define a rocker area about which said foot portion can rock to lower the junction of said foot and leg portions of each said member.

4. A carrying device according to claim 3 in which said foot portion between said rocker area and said junction has a thickness no greater than the space between the outer surfaces of corrugated cardboard so the foot portion of each said member can be run into and between said outer surfaces.

5. A device for temporary attachment to a carton to facilitate carrying the carton, an elongated handle including a hand grip and having two ends, a pair of rigid, generally L-shaped members each pivotally connected to one end of said handle for movement about an axis generally parallel to the longitudinal axis of said handle, each member having a leg portion and an elongated foot portion extending therefrom generally parallel to said handle, each said foot portion being at least substantially as long as said handle, each said foot portion extending from said leg portion in the same direction as said handle and at least substantially as far as said handle extends from said leg portion, the pivotal connection of said members to said handle enabling said foot portions to be spread apart while generally underlying said handle, the free end of each of said foot portions being sharpened to facilitate puncturing a carton to enable insertion of said foot portions under the top of the carton to carry the weight of the carton without imparting a twist or torque to said handle, said members being movable about their pivot axes to bring said foot portions together and generally coplanar with said handle.

* * * * *